US008028557B2

(12) United States Patent
Voth

(10) Patent No.: US 8,028,557 B2
(45) Date of Patent: Oct. 4, 2011

(54) METHODS AND APPARATUS FOR FORMING STIFFENING STRUCTURES IN A STRIP MATERIAL

(75) Inventor: Verne D. Voth, Hesston, KS (US)

(73) Assignee: The Bradbury Company, Inc., Moundridge, KS (US)

( * ) Notice: Subject to any disclaimer, the term of this patent is extended or adjusted under 35 U.S.C. 154(b) by 1628 days.

(21) Appl. No.: 10/936,415

(22) Filed: Sep. 8, 2004

(65) Prior Publication Data

US 2006/0048558 A1 Mar. 9, 2006

(51) Int. Cl.
*B21D 5/08* (2006.01)
*B21B 15/00* (2006.01)

(52) U.S. Cl. ..... 72/181; 72/177

(58) Field of Classification Search ..... 72/180, 72/181, 176, 177, 179, 168, 187, 197, 405.01, 72/166, 178, 182, 385, 379.6
See application file for complete search history.

(56) References Cited

U.S. PATENT DOCUMENTS

| | | | | |
|---|---|---|---|---|
| 2,708,958 | A * | 5/1955 | Crafton | 72/129 |
| 3,690,137 | A * | 9/1972 | Cookson | 72/180 |
| 3,859,832 | A | 1/1975 | Siegwart | |
| 4,151,732 | A * | 5/1979 | Hofstede et al. | 72/16.4 |
| 5,056,348 | A * | 10/1991 | Albrecht et al. | 72/177 |
| 5,125,258 | A * | 6/1992 | Warner | 72/379.2 |
| 6,092,349 | A | 7/2000 | Trenerry | 52/730.6 |
| 2003/0235680 | A1 * | 12/2003 | Zakarian | 428/184 |

FOREIGN PATENT DOCUMENTS

| | | | |
|---|---|---|---|
| DE | 2228496 | A1 | 1/1974 |
| DE | 199 50 890 | C1 | 10/2001 |
| GB | 2 181 467 | A | 4/1987 |
| GB | 2 228 752 | A | 9/1990 |
| IE | S970140 | | 5/1997 |
| IE | 970139 | | 6/1998 |
| WO | 03/095758 | A1 | 11/2003 |

OTHER PUBLICATIONS

European Office action corresponding to European application No. 05019554.4-2302, dated Oct. 20, 2006, 5 pages.
*European Search Report* corresponding to European Application No. EP 05 01 9554, Oct. 20, 2005, 1 page.
Annex to the European Search Report on European Patent Application No. EP 05 01 9554, Oct. 20, 2005, 1 page.
Written Opinion corresponding to European Application No. EP 05 01 9554, Oct. 20, 2005, 4 pages.

(Continued)

*Primary Examiner* — Debra Sullivan
(74) *Attorney, Agent, or Firm* — Hanley, Flight and Zimmerman, LLC

(57) ABSTRACT

Methods and apparatus of forming stiffening structures in a material are disclosed. In an example method, a first bend line is formed in the material and a portion of the material is drawn toward the first bend line to form an intermediate stiffening structure. A second bend line is then formed adjacent and parallel to the first bend line so that the intermediate stiffening structure is located between the first and second bend lines. A plurality of stiffening structures is then formed in the intermediate stiffening structure without substantially stretching the material.

35 Claims, 12 Drawing Sheets

OTHER PUBLICATIONS

Outinen, J., "Profiled Steel Sheeting," Seminar on Steel Structures: Design of Cold-Formed Steel Structures, Otamedia Oy, Espoo 2000, Finland. ISBN 951-22-5200 pp. 1-13. Retrieved from the Internet:< URL: http://www.hut.fi/Yksikot/Rakennus/Teras/Julkaisut/TKK-TER-series/TKK-TER-15.pdf>.

Hara, R., "Design of Cold Formed Thin Guage Member," Seminar on Steel Structures: Design of Cold-Formed Steel Structures, Otamedia Oy, Espoo 2000, Finland. ISBN 951-22-5200 pp. 14-33. Retrieved from the Internet:< URL: http://www.hut.fi/Yksikot/Rakennus/Teras/Julkaisut/TKK-TER-series/TKK-TER-15.pdf>.

* cited by examiner

METHODS AND APPARATUS FOR FORMING STIFFENING STRUCTURES IN A STRIP MATERIAL

FIELD OF THE DISCLOSURE

The present disclosure relates generally to material production processes and, more particularly, to methods and apparatus for forming stiffening structures in a strip material.

BACKGROUND

Typically, roll-forming processes are used to manufacture components such as structural beams, siding, ductile structures, and/or any other component having a formed profile. A roll-forming process may be implemented using a roll-former machine or system having a sequenced plurality of forming passes. Each of the forming passes typically includes a roll assembly configured to contour, shape, bend, cut, and/or fold a moving material. The number of forming passes required to form a component may be dictated by the characteristics of the material (e.g., the material strength) and the profile of the formed component (e.g., the number of bends, folds, etc. needed to produce a finished component). The moving material may be, for example, a metallic strip material that is unwound from coiled strip stock and moved through the roll-former system. As the material moves through the roll-former system, each of the forming passes performs a forming operation on the material to shape progressively the material to achieve a desired profile. For example, the cross-sectioned profile of a C-shaped component (well known in the art as a CEE) has the appearance of the letter C.

A roll-forming process may be a post-cut process or a pre-cut process. A post-cut process involves unwinding a strip material from a coil and feeding the strip material through a roll-former system. In some cases, the strip material is leveled, flattened, or otherwise conditioned prior to entering the roll-former system. A plurality of bending, folding, and/or forming operations is then performed on the strip material as it moves through the forming passes to produce a formed material having a desired profile. The formed material is then removed from the last forming pass and moved through a cutting or shearing press that cuts the formed material into sections having a predetermined length. In a pre-cut process, the strip material is passed through a cutting or shearing press prior to entering the roll-former system. In this manner, pieces of formed material having a pre-determined length are individually processed by the roll-former system.

Formed components are typically used in structure and building construction applications because of their lightweight properties and ability to withstand considerable tension, compression, and bending forces. Formed components are typically manufactured to withstand specified amounts of force before the components exhibit structural failure. Structural failure may occur in the form of buckling such as, for example, global buckling and local buckling. Global buckling generally refers to a structural failure of at least a substantial portion of a formed component. On the other hand, local buckling generally involves a structural failure of a localized portion or a relatively small portion of a formed component. If a formed component is subjected to a plurality of extreme forces causing multiple local bucklings, the multiple local bucklings may lead to global buckling.

The structural strength of a formed component can be determined by applying forces to the formed component in various directions and at various locations and measuring the amount of force required to cause structural failure. Varying the structural strength of formed components is traditionally accomplished in several different manners. One known manner in which manufacturers vary the structural strength of formed components involves producing formed components having different profiles (e.g., a U-profile, a C-profile, a Z-profile, an L-profile, a hat profile, etc.). Each profile provides different structural properties. Thus, certain profiles may be particularly suited for use in particular applications.

Another known manner used to vary the structural strength of formed components involves varying the properties of the materials used to form the components. For example, manufacturers may vary material strength, hardness, thickness, etc. Although selecting certain material properties can be an effective manner of varying the structural strength of formed components, the amount by which the material properties can be varied is often limited by the technology or methods (e.g., roll-forming methods) used to form the components. More specifically, roll-forming machines may not be capable of providing the bending forces required to bend materials that are too strong or too thick. Additionally, varying material properties such as, for example, material thickness may result in formed components that are too costly.

Yet another known method used to vary the structural strength of formed components involves forming a plurality of adjacent parallel rib-like or bead-like features extending along a length of a formed component. The rib-like or bead-like features are typically stamped into a strip material prior to forming a formed component. However, stamping significantly stretches and thins the strip material, which may weaken the material near the rib-like features and can make it difficult to control precisely the overall dimensions of a finished component made from the material.

DETAILED DESCRIPTION

Figure 1A:
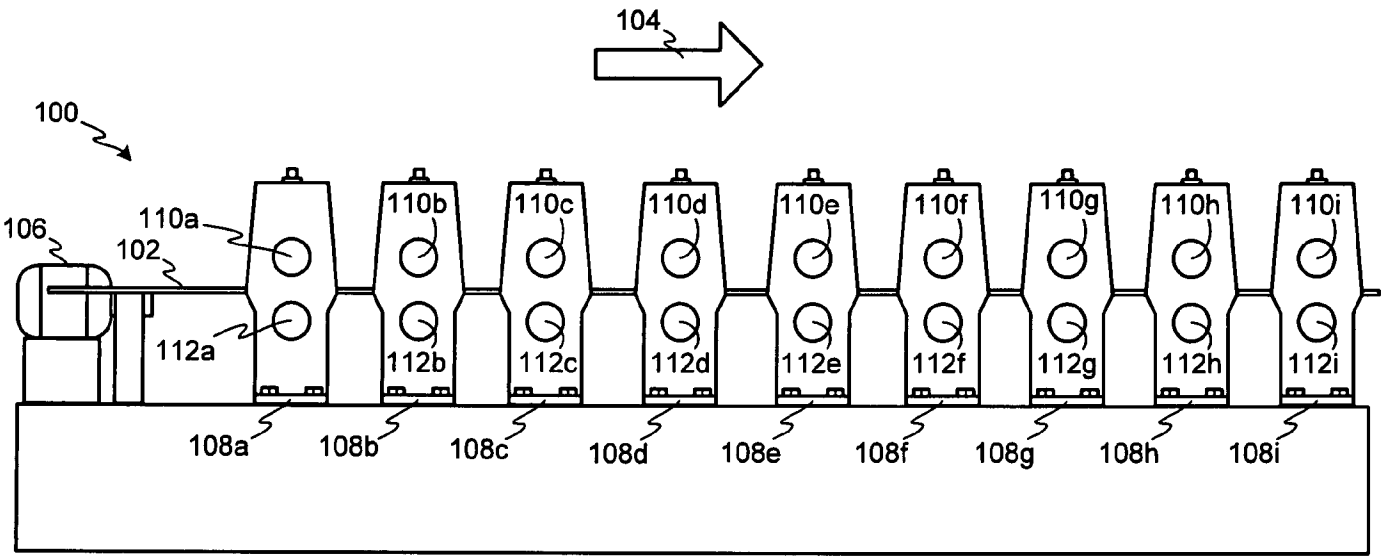
FIG. 1A is an elevational view and FIG. 1B is a plan view of an example roll-former system that may be used to form stiffening structures in a strip material.
Figure 1B:
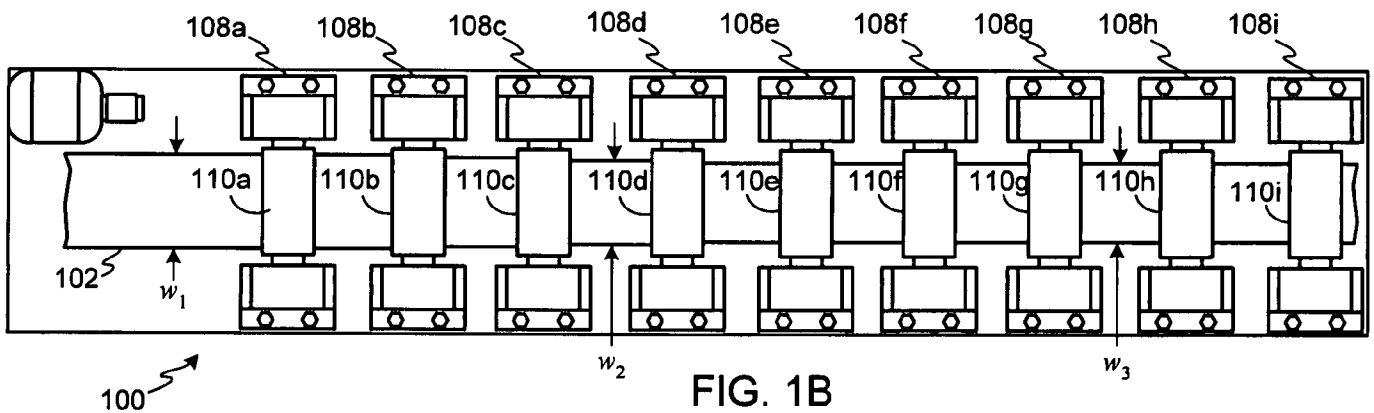
Figure 2:
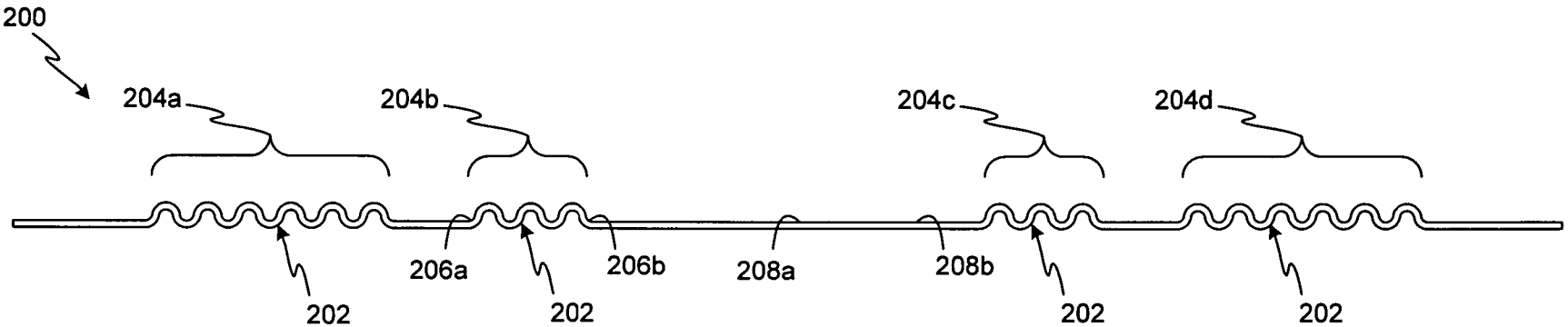
FIG. 2 is a profile of an example reinforced strip material having stiffening structures formed thereon.

FIG. 1A is an elevational view and FIG. 1B is a plan view of an example roll-former system 100 that may be used to form stiffening structures in a strip material 102. The example roll-former system 100 may be part of, for example, a continuously moving material manufacturing system. Such a continuously moving material manufacturing system may include a plurality of subsystems that modify or alter the material 102 using processes that, for example, unwind, fold, punch, cut, and/or stack the material 102. The material 102 may be a metallic strip or sheet material supplied on a roll or may be any other metallic or non-metallic material. Additionally, the continuous material manufacturing system may include the example roll-former system 100 which, as described in detail below, may be configured to receive the strip material 102 and form a plurality of stiffening structures (e.g., the example stiffening structures 202 of FIG. 2) thereon to produce a substantially planar reinforced strip material 200 as shown in FIG. 2. The reinforced strip material 200 may then be used to produce formed components (e.g., the C-shaped component 300 of FIGS. 3A and 3B) via subsequent roll-forming processes.

The stiffening structures described herein may be formed as a plurality of substantially parallel adjacent ribs, beads, ridges, crimps or the like that extend along a length or longitudinal axis of a strip material. Each of the longitudinal ribs, beads, ridge, crimps, etc. has a substantially curved profile or cross-section that can be formed by the methods and apparatus described herein without imparting any substantial localized stretching or thinning to the strip material being formed. In some examples, the stiffening structures may form one or more corrugated sections extending along at least a part of the length of the strip material. Each of the corrugated sections may include a plurality of adjacent ribs, beads, ridges, crimps, or the like that form a plurality of adjacently located and substantially curved cross-sections.

Stiffening structures such as, for example, the example stiffening structures 202 (FIG. 2) may be used to strengthen, reinforce, or increase the rigidity of formed components, which increases the amount of tension, compression, and bending forces that such a formed component can withstand before experiencing structural failure (e.g., global buckling and/or local buckling). As noted above, known methods of increasing the strength of formed components often involve using thicker material to increase the amount of material present between any two points or within a particular region on the formed component. However, this can be costly and there is often a limit to the material thickness that can be formed in a roll-former system. In contrast, the example methods and apparatus described herein may be used to increase the amount of material between two points or within a particular region of a formed component without having to increase the thickness of the material used to produce the formed component.

As described in greater detail below, the amount of material between two points or within a region of the strip material or formed component may be increased by drawing or gathering the material into a specific zone or region (e.g., a reinforced zone) to form a relatively large intermediate curved rib-like or bead-like structure or formation. The intermediate curved rib-like structure or formation is a curved raised portion of material from which a plurality of stiffening structures (e.g., adjacent and substantially parallel ribs, beads, etc.) are formed by performing a series of further bending and/or forming operations on the material of the intermediate curved rib-like or bead-like formation. In this manner, the intermediate curved rib-like formation is gathered to form a group of adjacent stiffening structures that may form a corrugated section or a substantially planar reinforced zone (e.g., the reinforced zones 204*a-d* of FIG. 2).

Unlike known methods for forming rib-like or bead-like structures, drawing or gathering material into a zone or region as described below does not locally stretch the material and, thus, preserves the thickness and strength of the material in that zone or region. Additionally, because the example methods described herein substantially eliminate localized stretching and thinning of the material being formed, the stiffening structures described herein may be incorporated into formed components while maintaining precise control over the overall dimensions of the formed components. Further, the substantial elimination of localized stretching and thinning of the material being formed into stiffening structures enables a precise amount of additional material to be gathered into a zone or region of the component to increase the strength and/or rigidity of the component. In some examples, the methods and apparatus described herein may be used to add 10% additional material, 15% additional material, 20% additional material, and/or any other desired amount of additional material to a zone or region to be reinforced.

Figure 3A:
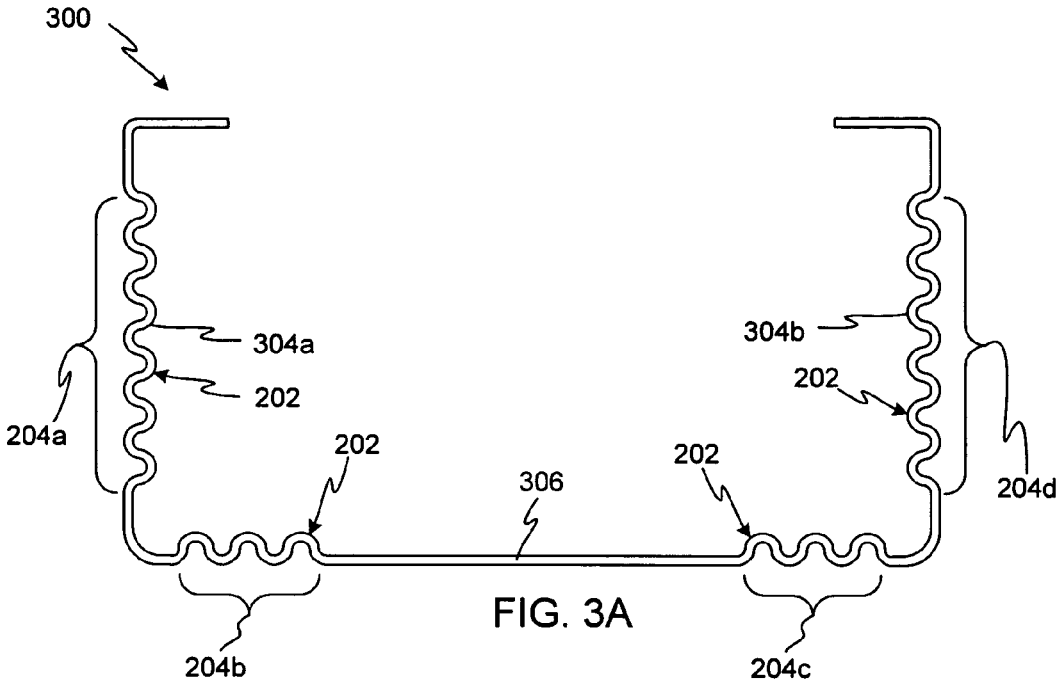
FIG. 3A is a profile view and FIG. 3B is an isometric view of a C-shaped component having stiffening structures formed thereon.
Figure 3B:
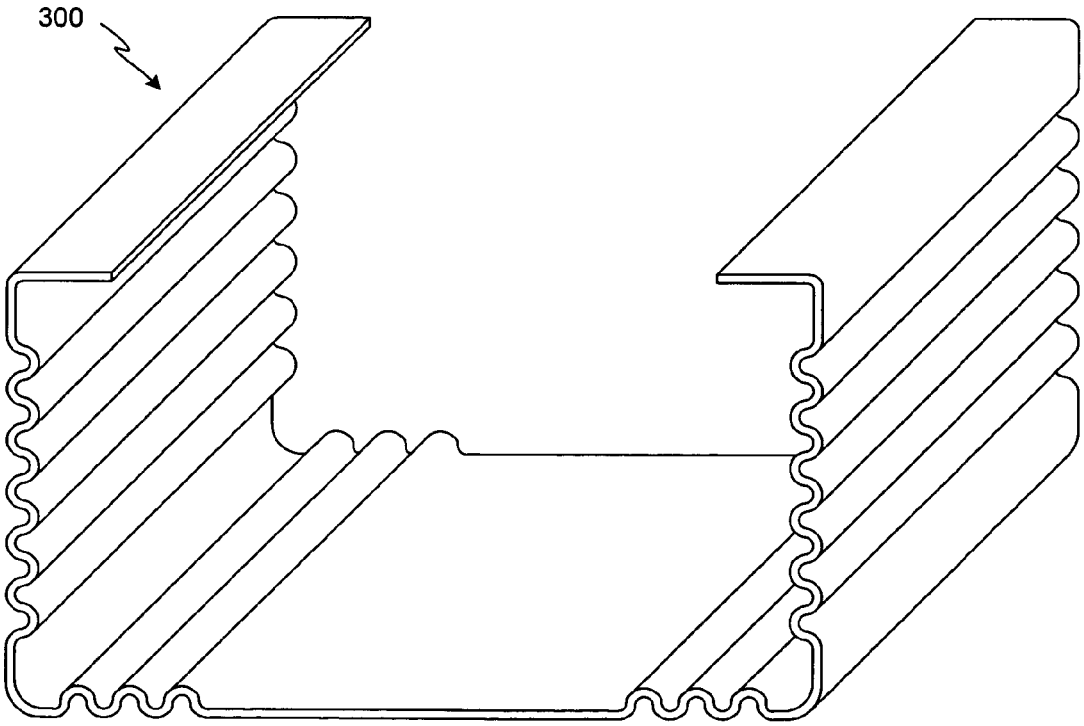

In addition, in contrast to increasing the overall thickness of a material, the example stiffening structures described herein enable specific zones of a formed component to be stiffened by only increasing the amount of material between selected points and/or in selected regions. For example, if a manufacturer desires more strength only in the web portion (e.g., the web 306 of FIG. 3A) of a formed component, stiffening structures may be formed only on the web portion without affecting the flanges (e.g., the flanges 304*a-b* of FIG. 3A) of the formed component. In this manner, the cost of the finished formed component is not increased by using thicker material when only specific zones of the formed component require additional strength or stiffness. For purposes of clarity, FIGS. 3A and 3B illustrate the example stiffening structures 202 (FIG. 2) formed on an example component 300 having a C-shaped profile (i.e., a CEE profile). Formed components such as the example component 300 are commonly referred to in the metal forming industry as purlins.

The example roll-former system 100 may be configured to form, for example, the example stiffening structures 202 in a substantially continuous material in a post-cut roll-forming operation or from a plurality of sheets of material in a pre-cut roll-forming operation. If the material 102 is a substantially continuous material, the example roll-former system 100 may be configured to receive the material 102 from an unwind stand (not shown) and drive, move, and/or translate the material 102 in a direction generally indicated by an arrow 104. Alternatively, if the material 102 is a pre-cut sheet of material (e.g., a fixed length of a strip material), the example roll-former 100 may be configured to receive the material 102 from a shear (not shown).

The example roll-former system 100 includes a drive unit 106 and a plurality of forming passes 108*a-i*. The drive unit 106 may be operatively coupled to and configured to drive portions of the forming passes 108*a-i* via, for example, gears, pulleys, chains, belts, etc. Any suitable drive unit such as, for example, an electric motor, a pneumatic motor, etc. may be used to implement the drive unit 106. In some instances, the drive unit 106 may be omitted from the example roll-former system 100 and the forming passes 108*a-i* may be operatively coupled to a drive unit of another system in a material manufacturing system. For example, if the example roll-former system 100 is operatively coupled to a material unwind system having a material unwind system drive unit, the material unwind system drive unit may be operatively coupled to the forming passes 108*a-i*.

The forming passes 108*a-i* work cooperatively to fold and/or bend the material 102 to form the example stiffening structures 202. Each of the forming passes 108*a-i* includes two forming rolls 110 and 112 (i.e., top forming rolls 110*a-i* and bottom forming rolls 112*a-i*), which are shown in detail in FIGS. 8-16. The forming rolls 110*a-i* and 112*a-i* are configured to apply bending forces to the material 102 as the material 102 is driven, moved, and/or translated through the example roll-former system 100 in the direction 104. More specifically, as the material 102 moves through the example roll-former system 100, each of the forming passes 108*a-i* performs an incremental bending or forming operation on the material 102 as described in detail below in connection with FIG. 7. For example, a single stiffening structure may be formed incrementally via a plurality of passes, each of which performs a first forming operation, an intermediate forming operation, or a final forming operation.

The number of forming passes in the example roll-former system 100 may vary based on the number of stiffening structures and/or the number of reinforced zones (e.g., the reinforced zones 204*a-d* of FIG. 2) to be formed. In addition, the number of forming passes in the example roll-former system 100 may vary based on, for example, the strength, thickness, and type of the material 102.

As shown in FIG. 1B, as the material 102 moves through each of the forming passes 108*a-i* and the stiffening structures 202 (FIG. 2) are incrementally shaped or formed, material is drawn into the regions or zones associated with the stiffening structures 202 and the overall or effective width of the material 102 is reduced. For example, the strip material 102 may have a width of $w_1$ when initially entering the forming pass 108*a* and, after exiting subsequent roll-forming passes 108*c* and 108*g*, may have widths $w_2$ and $w_3$, respectively.

FIG. 2 is a profile of the example reinforced strip material 200 having the example stiffening structures 202 formed thereon. The reinforced strip material 200 may be formed by the example roll-former system 100 described above in connection with FIG. 1. The reinforced strip material 200 includes four reinforced regions or zones 204*a*, 204*b*, 204*c*, and 204*d* (i.e., a first reinforced zone 204*a*, a second reinforced zone 204*b*, a third reinforced zone 204*c*, and a fourth reinforced zone 204*d*). The amount of material in each of the reinforced zones 204*a-d* is increased by drawing material into the reinforced zones 204*a-d* to form the stiffening structures 202 using, for example, the roll-former system 100. For example, the second reinforced zone 204*b* includes stiffening structures formed between points 206*a* and 206*b* so that the amount of material between the points 206*a* and 206*b* is greater than the amount of material between similarly spaced points 208*a* and 208*b* that lie along a flat portion of the reinforced strip material 200.

Known methods for forming recesses and other types of stiffening structures in strip material often use a stamping method or a roll forming method that does not draw the material into regions (e.g., the reinforced zones 204*a-d*), but instead stretches the material into a desired shape. Unlike the example methods and apparatus described herein which progressively draw material into a region, stamping and/or stretching material often leads to reducing the thickness of the material so that zones having stiffening structures or recesses have less or the same amount of material as they did prior to the stamping or forming operation. This may cause metal finishes (e.g., galvanization) to crack and the material strength to decrease in the formed region(s).

In contrast to known methods for forming recesses or other types of stiffening structures, the example forming methods described herein progressively draw material into a zone to substantially minimize or prevent reducing the material thickness so that an amount of material in a given zone can be increased in a precisely controlled manner. In other words, the example methods and apparatus described herein may be used to form stiffening structures in a strip material while maintaining the integrity of the strip material. The integrity of the strip material is substantially preserved throughout a roll forming process by not substantially weakening, stretching, or cracking the material. In this manner, material characteristics, component characteristics, and structural characteristics may be substantially preserved or not substantially degraded. Such characteristics may include thickness, wholeness, strength, and rigidity. In addition, the roll forming process may be implemented so that the finish (e.g., a galvanized finish) of a strip material is not cracked, flaked, peeled away, or otherwise altered or degraded.

FIG. 3A is a profile view and FIG. 3B is an isometric view of the C-shaped component 300 having the example stiffening structures 202 formed thereon. The example C-shaped component 300 may be formed using a roll-forming process following the formation of the stiffening structures 202. More specifically, after the stiffening structures 202 are formed to produce the reinforced strip material 200, the C-shaped component 300 may be formed by feeding the reinforced strip material 200 into a roll-former system configured to form the C-profile (i.e., the CEE profile) illustrated in FIGS. 3A and 3B. Although the C-shaped component 300 is shown by way of example, the reinforced strip material 200 may be used to form components having any other profile.

As shown in FIG. 3A, the C-shaped component 300 includes two flange structures 304*a* and 304*b*, and a web structure 306 disposed between the flange structures 304*a* and 304*b*. The C-shaped component 300 is formed so that the first reinforced zone 204*a* (FIG. 2) and the fourth reinforced zone 204*d* (FIG. 2) are located on the flange structures 304*a* and 304*b*, respectively, and the second reinforced zone 204*b* (FIG. 2) and the third reinforced zone 204*c* (FIG. 2) are located on the web structure 306. However, stiffening structures may be formed on less or more locations of a formed component. For example, if a component manufacturer desires to increase strength only in the web structure 306, the example roll-former system 100 may be configured to form the stiffening structures 202 only at the second reinforced zone 204*b* and the third reinforced zone 204*c*. In this manner, when the C-shaped component 300 is formed, the flange structures 304*a* and 304*b* will be substantially flat (i.e., without the stiffening structures 202).

Figure 4:
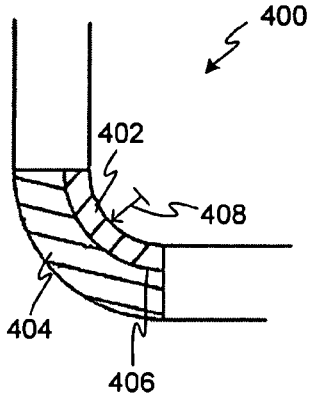
FIG. 4 is an example bend zone formed in a material illustrating a material compression region and a material stretch region.

FIG. 4 is an example bend zone 400 formed in a material (e.g., the example strip material 102 of FIG. 1) illustrating a material compression region 402 and a material stretch region 404. The forming techniques used in combination with the example roll-former system 100 (FIG. 1) may be used to add any additional desired amount of material to a given reinforcement zone (e.g., the reinforcement zones 204*a-d* of FIG. 2) by varying the ratio of the material compression region 402 thickness to the material stretch region 404 thickness (i.e., the thickness ratio).

As shown in FIG. 4, the material compression region 402 is about one-third the thickness of the material stretch region 404, both of which are separated by a neutral axis 406. The neutral axis 406 defines the material layer that is neither stretched nor compressed. During folding or bending operations, material is compressed on an inner radius of curvature and stretched on an outer radius of curvature at bend zones (e.g., the bend zone 400), which creates the material compression region 402 and the material stretch region 404. By minimizing the material stretch region 404 during a bending operation, the amount of material in the bend zone 400 after the bending operation remains substantially the same as before the bending operation. In contrast, increasing the material stretch region 404 reduces the amount of a material in the bend zone 400 following a bending operation.

The thickness of the material stretch region 404 may be minimized by implementing a forming operation (e.g., a roll forming operation) that maintains the neutral axis 406 near the center of the material thickness, thereby balancing the thickness ratio of the material compression region 402 and the material stretch region 404. The location of the neutral axis 406 may be varied by varying a radius of curvature 408 of a bend with respect to the thickness of a material. For example, if the radius of curvature 408 is relatively small relative to the material thickness, the material stretch region 404 may become substantially thicker than the material compression region 402, which results in stretching the material and not increasing an amount of material within a given region.

Figure 5A:
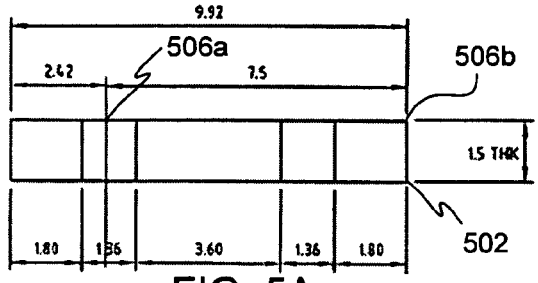
FIG. 5A illustrates a flat strip material and FIG. 5B illustrates an example stiffening structure formed from the flat strip material of FIG. 5A.
Figure 5B:
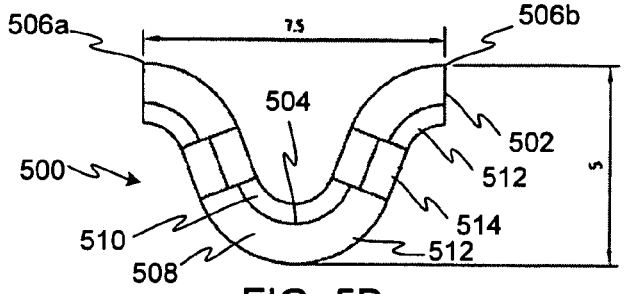

FIG. 5A illustrates an example flat strip material 502 and FIG. 5B illustrates an example stiffening structure 500 formed from the flat strip material 502 of FIG. 5A. The example stiffening structure 500 may be roll formed using, for example, the example roll-former system 100 (FIG. 1) and the example roll forming methods described below. The example material 502 is 9.92 mm in length prior to a bending operation and is used to form the stiffening structure 500 having a height of 5 mm and a pitch of 7.5 mm between a first location 506*a* and a second location 506*b*. In addition, at bent portions 512 of the material 502, the neutral axis 504 is located at one-third the thickness of the material 502 such that a material stretch region 508 is thicker than a material compression region 510. The thickness of the material stretch region 508 causes the material 502 to be thinner at the bent portions 512 than at non-bent portions 514. Following a roll forming process the amount of material between the locations 506*a* and 506*b* increases by 24%.

Figure 6A:
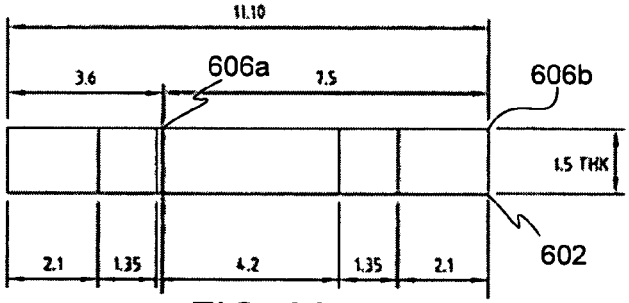
FIG. 6A illustrates another flat strip material and FIG. 6B illustrates another example stiffening structure formed from the flat strip material of FIG. 6A.
Figure 6B:
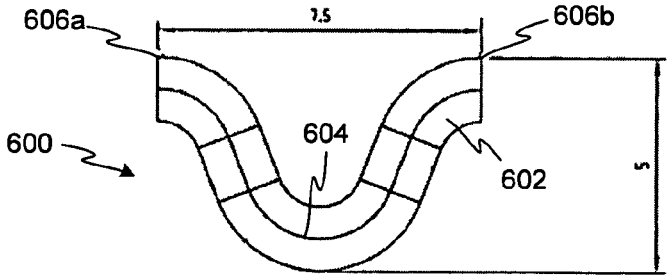

FIG. 6A illustrates another flat strip material 602 and FIG. 6B illustrates another example stiffening structure 600 formed from the flat strip material 602 of FIG. 6A. The example stiffening structure 600 may be roll formed using, for example, the example roll-former system 100 (FIG. 1) and the example roll-forming methods described below. The material 602 is 11.10 mm in length and is used to form the stiffening structure 600 having a pitch of 7.5 mm between a first location 606*a* and a second location 606*b* and a height of 5 mm. However, in contrast to the example stiffening structure 500 of FIG. 5, the stiffening structure 600 is formed so that the neutral axis 604 is located at the center of the material thickness. The location of the neutral axis 604 enables the thickness of the material 602 to remain substantially constant throughout the roll forming process so that the total amount of material between the locations 606*a* and 606*b* is 11.10 mm of material. Thus, the amount of material between the locations 606*a* and 606*b* increases by 32%.

Figure 7:
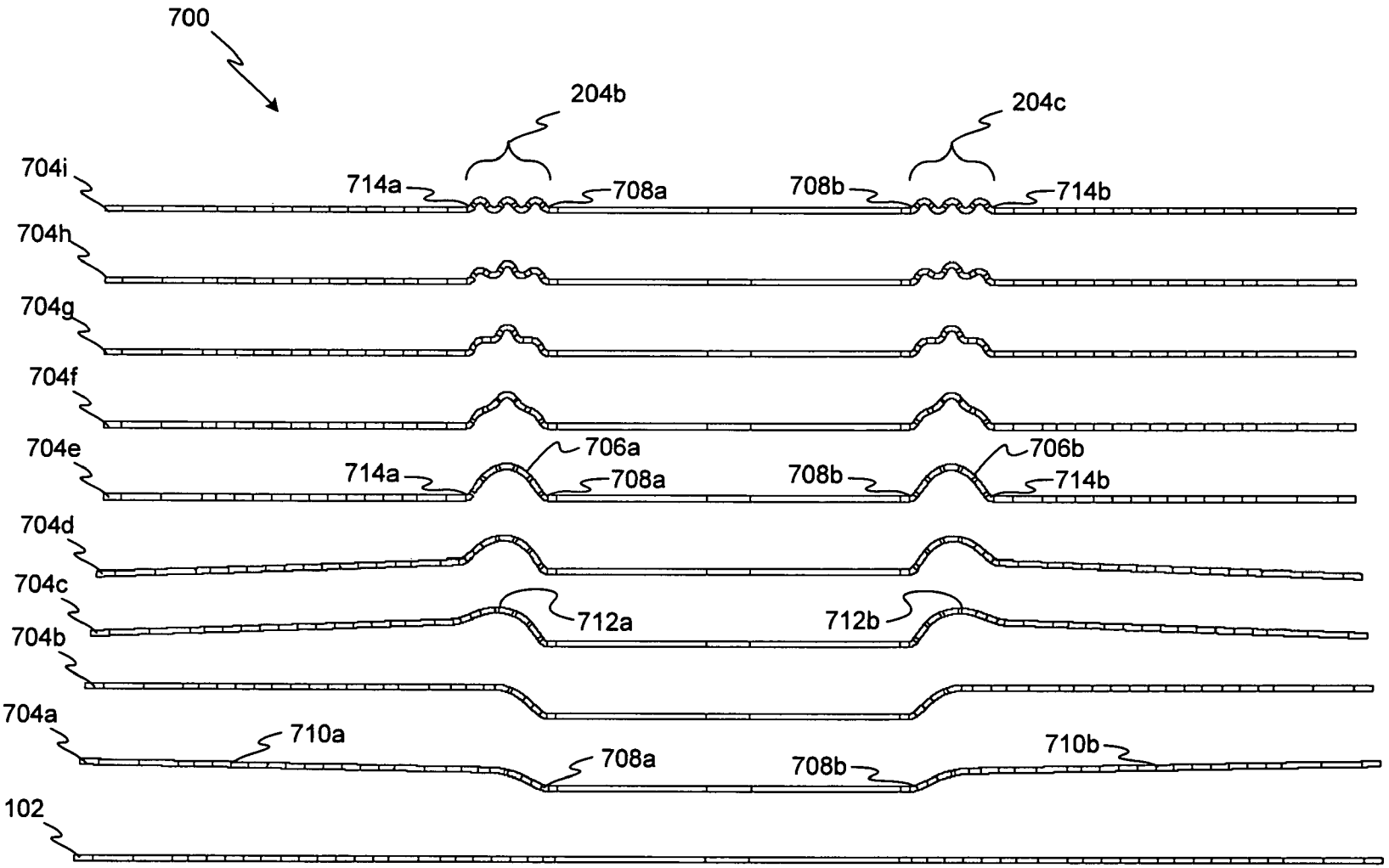
FIG. 7 is an example stiffening structure forming sequence that may be used to form stiffening structures in a strip material.
Figure 8:
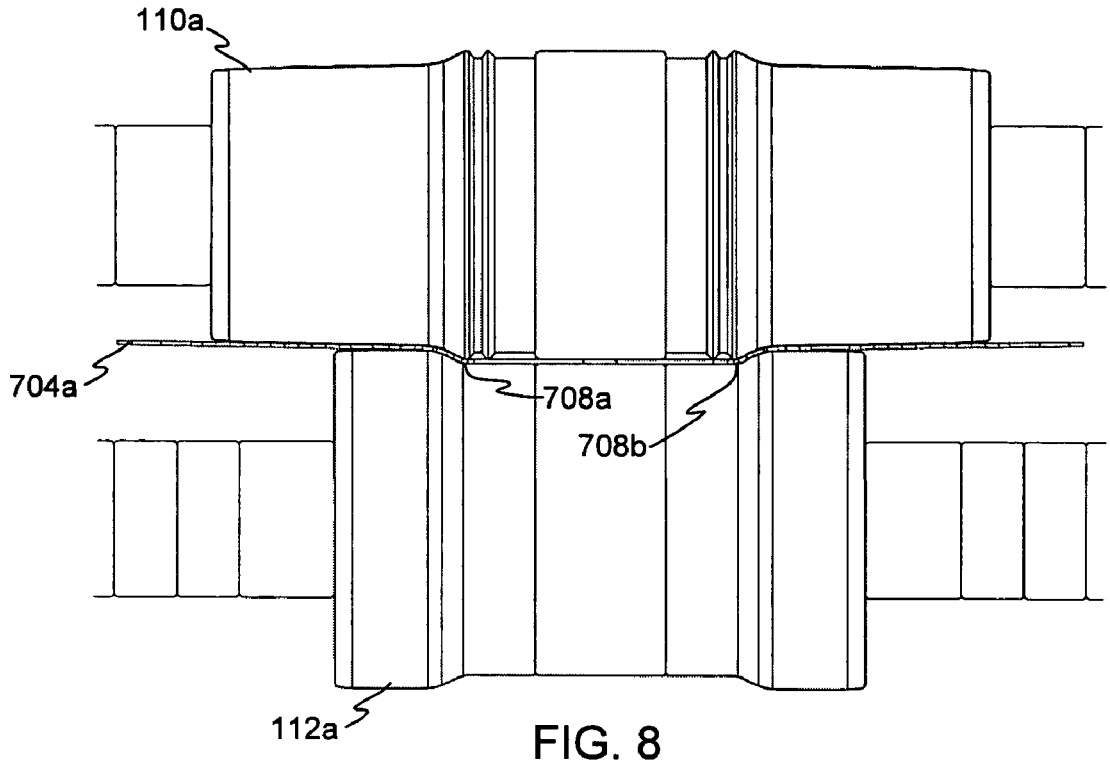
FIGS. 8-16 are example roll assemblies that may be used in the roll-former system of FIG. 1 to form stiffening structures according to the example stiffening structure forming sequence of FIG. 7.
Figure 9:
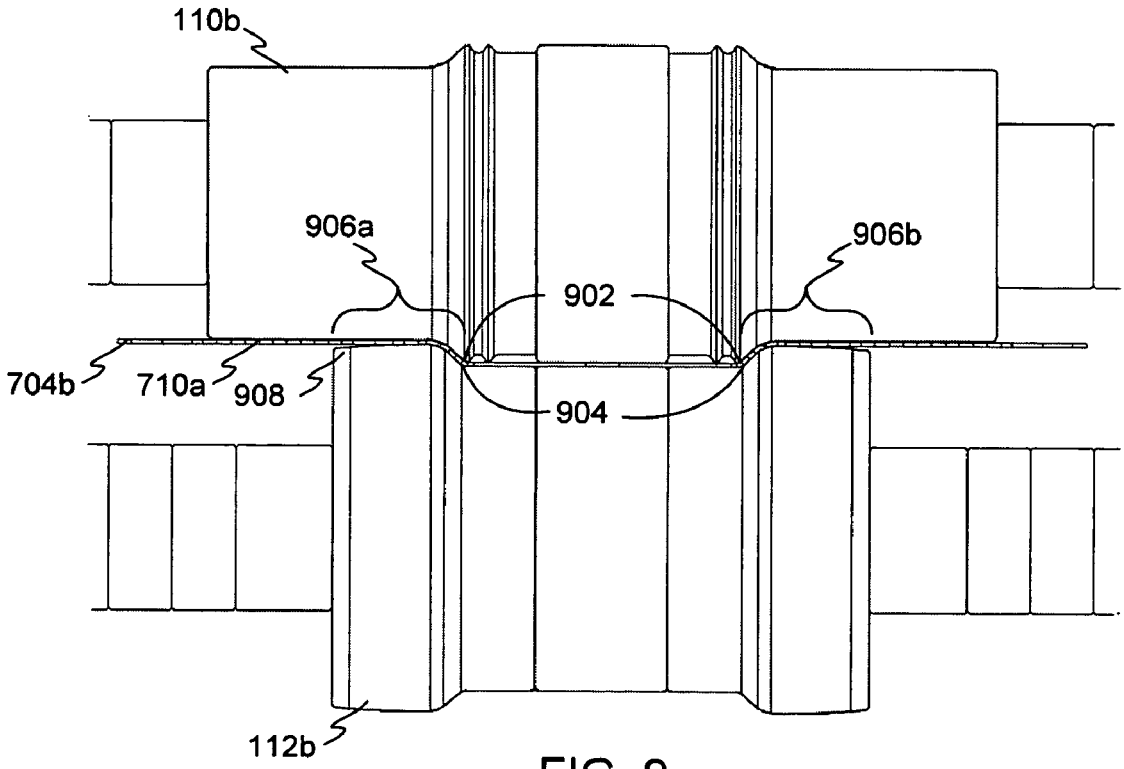
Figure 10:
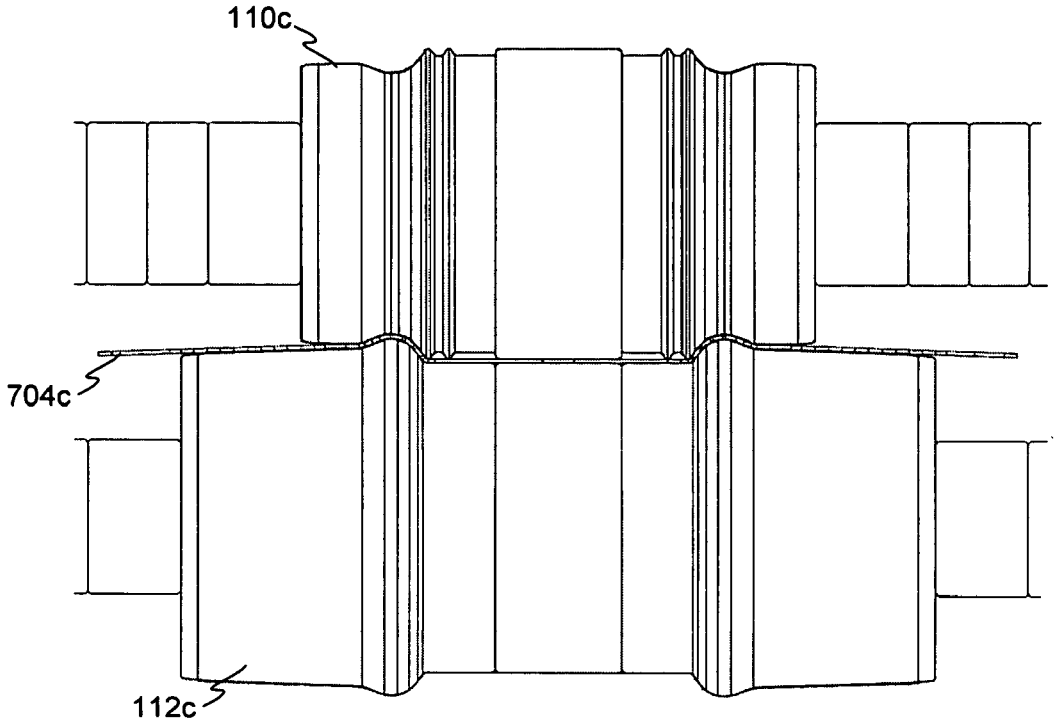
Figure 11:
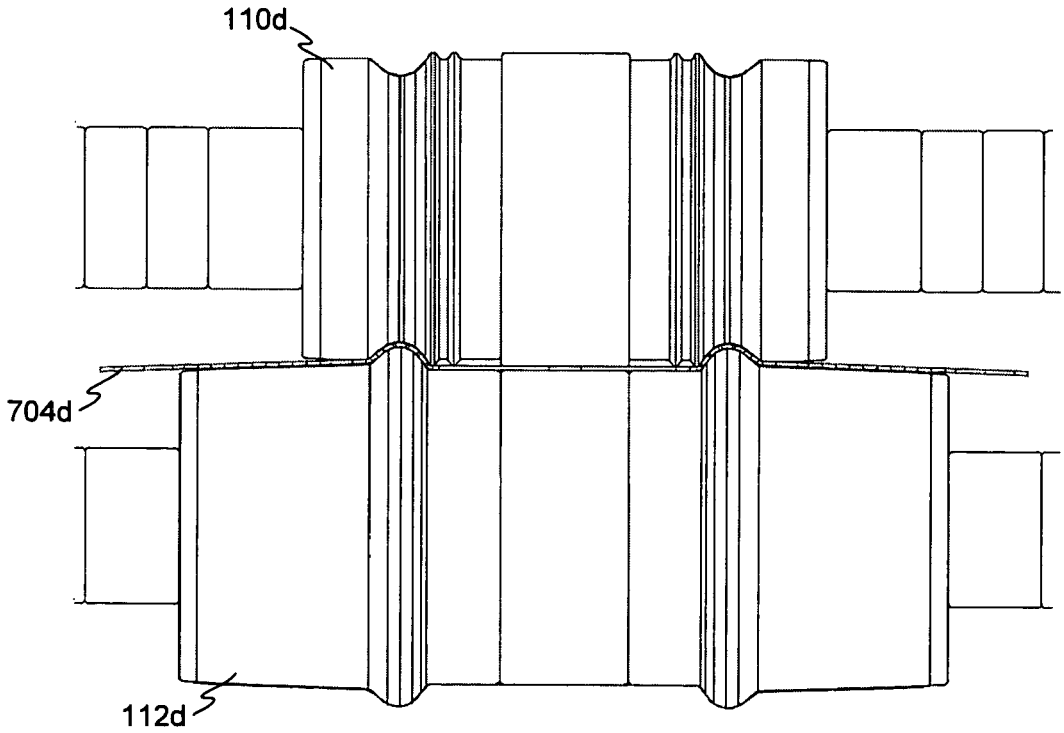
Figure 12:
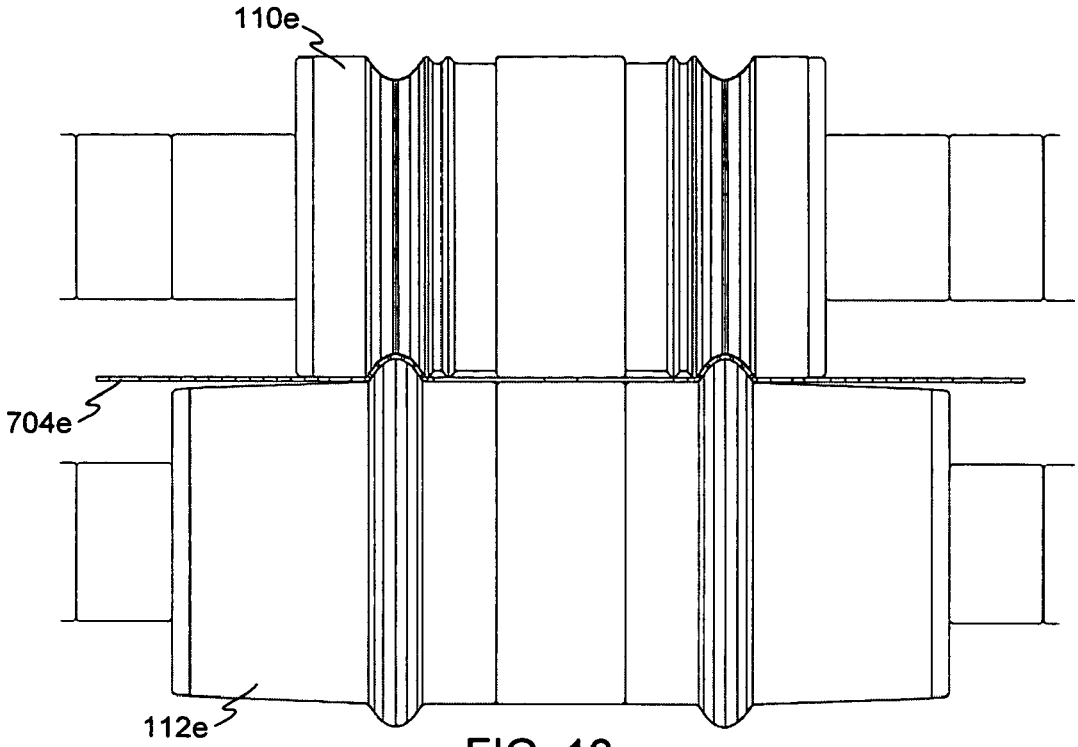
Figure 13:
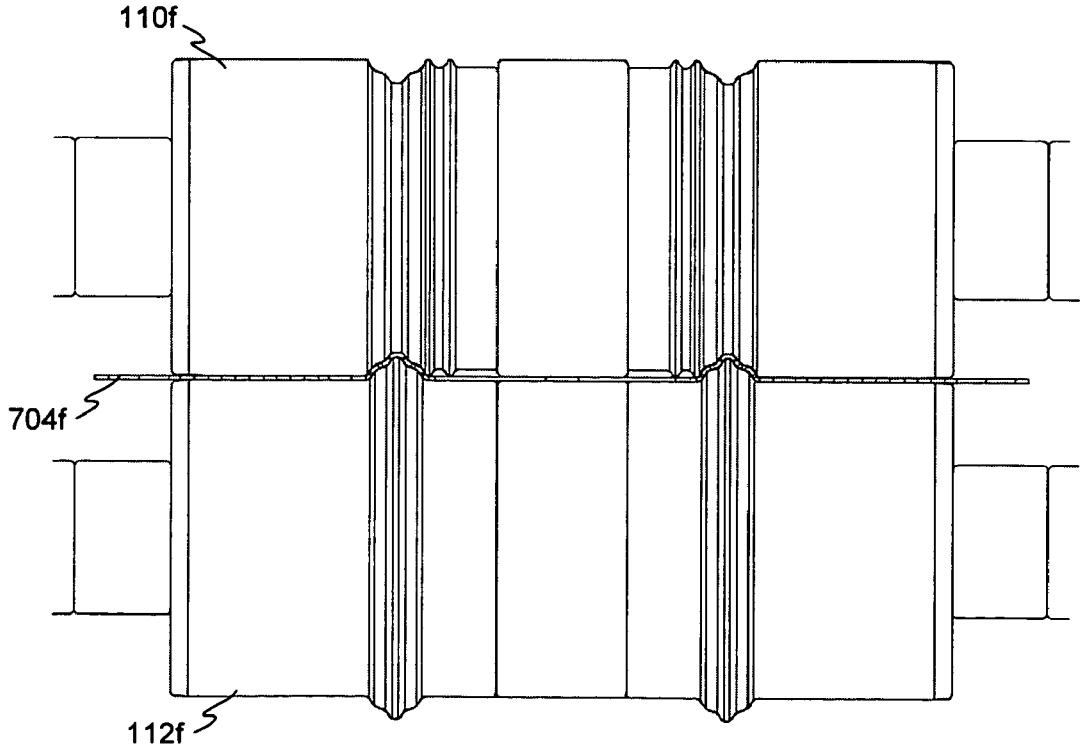

FIG. 7 is an example stiffening structure forming sequence 700 that may be used to form stiffening structures (e.g., the example stiffening structures 202 of FIG. 2) in a strip material (e.g., the strip material 102 of FIG. 1). The example forming sequence 700 is illustrated using a plurality of profiles 704*a*-704*i*, each corresponding to one of the forming passes 108*a-i* (FIG. 1), respectively. The forming sequence 700 may be implemented using, for example, the example roll-former system 100 (FIG. 1) and the example methods described herein. In general, the example forming sequence 700 illustrates the forming process of the reinforced zones 204*b* and 204*c* (FIG. 2).

As shown in FIG. 7, the reinforced zones 204*b* and 204*c* are formed by first forming intermediate rib-like or bead-like stiffening structures 706*a* and 706*b* (i.e., the intermediate stiffening structures 706*a* and 706*b*) and then forming the stiffening structures 202 in the material making up the intermediate stiffening structures 706*a* and 706*b*. The intermediate stiffening structures 706*a* and 706*b* are broad and relatively large curved raised portions of material from which a plurality of adjacent and parallel rib-like or bead-like stiffening structures are formed. The intermediate stiffening structures 706*a* and 706*b* are formed to draw a desired amount of material into the reinforced zones 204*b* and 204*c* so that the amount of material drawn into the intermediate stiffening structures 706*a* and 706*b* is the same amount of material within the reinforced zones 204*b* and 204*c*, respectively, after the stiffening structures 202 are formed.

As depicted in FIG. 7, the material 102 has an initial profile, which corresponds to an initial, substantially flat state. The intermediate stiffening structures 706*a* and 706*b* are formed in forming passes 108*a-e* of which the forming progression is illustrated by the profiles 704*a-e*. The profile 704*a* shows that the material 102 is bent at two bend lines 708*a* and 708*b* to begin forming the intermediate stiffening structures 706*a* and 706*b*. In addition, ends 710*a* and 710*b* of the material 102 are shown in the profile 704*a* as slanted upward. The upward slant indicates that the ends 710*a-b* of the material 102 are not restrained (i.e., not pinched) by end portions of forming rolls (e.g., the rolls 110*a* and 112*a* of FIG. 8). This prevents the material from being stretched as it is drawn toward the intermediate stiffening structures 706*a-b*.

The profile 704*b* illustrates that the material 102 is folded about the bend lines 708*a* and 708*b* to draw more material toward the reinforcement zones 204*b-c*. In addition, the profile 704*b* illustrates that the width ends 710*a* and 710*b* are returned to a substantially flat position.

In the profile 704*c*, the maximum locations 712*a* and 712*b* (i.e., the crests) of the intermediate stiffening structures 706*a* and 706*b*, respectively, are formed and the ends 710*a* and 710*b* are slanted downwards. The downward slant of the ends 710*a* and 710*b* indicates that the ends 710*a* and 710*b* are not captured or pinched by forming rolls (e.g., the forming rolls 110*c* and 112*c*).

The profile 704*d* illustrates the formation of the intermediate stiffening structures 706*a* and 706*b* and the profile 704*e* illustrates the formation of the intermediate stiffening structures 706*a* and 706*b*. More specifically, the first intermediate stiffening structure 706*a* is formed between a first outer bend line 714*a* and the first inner bend line 708*a* and the second intermediate stiffening structure 706*b* is formed between the second inner bend line 708*b* and the second outer bend line 714*b*.

As the stiffening structures 202 are formed from the intermediate stiffening structures 706*a* and 706*b*, the amount of material used to form the stiffening structures 202 remains constant or substantially similar to the amount of material used to form the intermediate stiffening structures 706*a* and 706*b*. In other words, the amount of material between the bend lines 714*a* and 708*a* in the profile 704*e* is substantially the same as the amount of material between the bend lines 714*a* and 708*a* in the profile 704*i*.

FIGS. 8-16 are example roll assemblies 110*a-i* and 112*a-i* that may be used in the roll-former system 100 of FIG. 1 to form stiffening structures (e.g., the stiffening structures 202 of FIG. 2) according to the example stiffening structure forming sequence of FIG. 7. Each roll assembly illustrated in each of the FIGS. 8-16 includes one of the upper rolls 110*a-i* and a corresponding one of the lower rolls 112*a-i*. Each of the roll assemblies (e.g., the rolls 110*a* and 112*a*) is configured to bend, fold, or otherwise form the strip material 102 (FIG. 1) according to one of the profiles 704*a-i* described above in connection with FIG. 7.

The roll assemblies of FIGS. 8-12 (i.e., the rolls 110*a-e* and 112*a-e*) are configured to draw material from the ends 710*a* and 710*b* of the strip material 102 (FIGS. 1 and 7) toward the bend lines 708*a* and 708*b* to form the intermediate stiffening structures 706*a* and 706*b*. To substantially reduce or prevent stretching or changing the thickness of the strip material 102 during formation of the intermediate stiffening structures 706*a* and 706*b*, the roll assemblies are configured to allow the ends 710*a* and 710*b* of the strip material 102 to move freely during the forming process. In this manner, as the ends 710*a* and 710*b* are drawn in, there are no pinching forces to cause the strip material 102 to stretch between the ends 710*a* and 710*b* and the bend lines 708*a* and 708*b*.

To prevent pinching forces on the ends 710*a* and 710*b*, the roll assemblies of FIGS. 8-12 are configured so that the strip material 102 is pinched or grabbed by the roll assemblies at the bend lines 708*a-b* (FIGS. 7 and 8) and locations therebetween. For example, as shown in detail in FIG. 9, the rolls 110*b* and 112*b* are configured to pinch or grab the strip material 102 between roll locations 902 and 904. However, at gap regions 906*a* and 906*b*, the rolls 110*b* and 112*b* are separated by a distance greater than a thickness of the strip material 102. In this manner, gaps between the corresponding upper and lower rolls 110*b* and 112*b* at the gap regions 906*a-b* are increased to allow the strip material 102 to move freely within the gap regions 906*a-b* and to be drawn into the intermediate stiffening structures 706*a* and 706*b* substantially without stretching any portion of the strip material 102. A gap in the gap region 906*a* is shown in detail at location 908 between the surfaces of the lower roll 112*b* and the upper roll 110*b*.

The roll assemblies of FIGS. 13-16 are configured to form the stiffening structures 202 (FIG. 2) using the material that was drawn by the roll assemblies of FIGS. 8-12 to form the intermediate stiffening structures 706*a* and 706*b*. Although the roll assemblies of FIGS. 13-16 are configured only to form the stiffening structures within the second and third reinforced zones 204*b* and 204*c* (FIG. 2), the roll assemblies of FIGS. 13-16 may be alternatively configured to simultaneously form outer intermediate stiffening structures (not shown) that correspond to the first and fourth reinforced zones 204*a* and 204*d* (FIG. 2). The stiffening structures 202 (FIG. 2) of the first and fourth reinforced zones 204*a* and 204*d* may then be formed in the outer intermediate stiffening structures by subsequent roll assemblies. In this manner, after forming the stiffening structures 202 of the second and third reinforced zones 204*b* and 204*c* and the outer intermediate stiffening structures, the strip material 102 may be moved through the subsequent roll assemblies to form the stiffening structures 202 of the first and fourth reinforced zones 204*a* and 204*d*.

Figure 17:
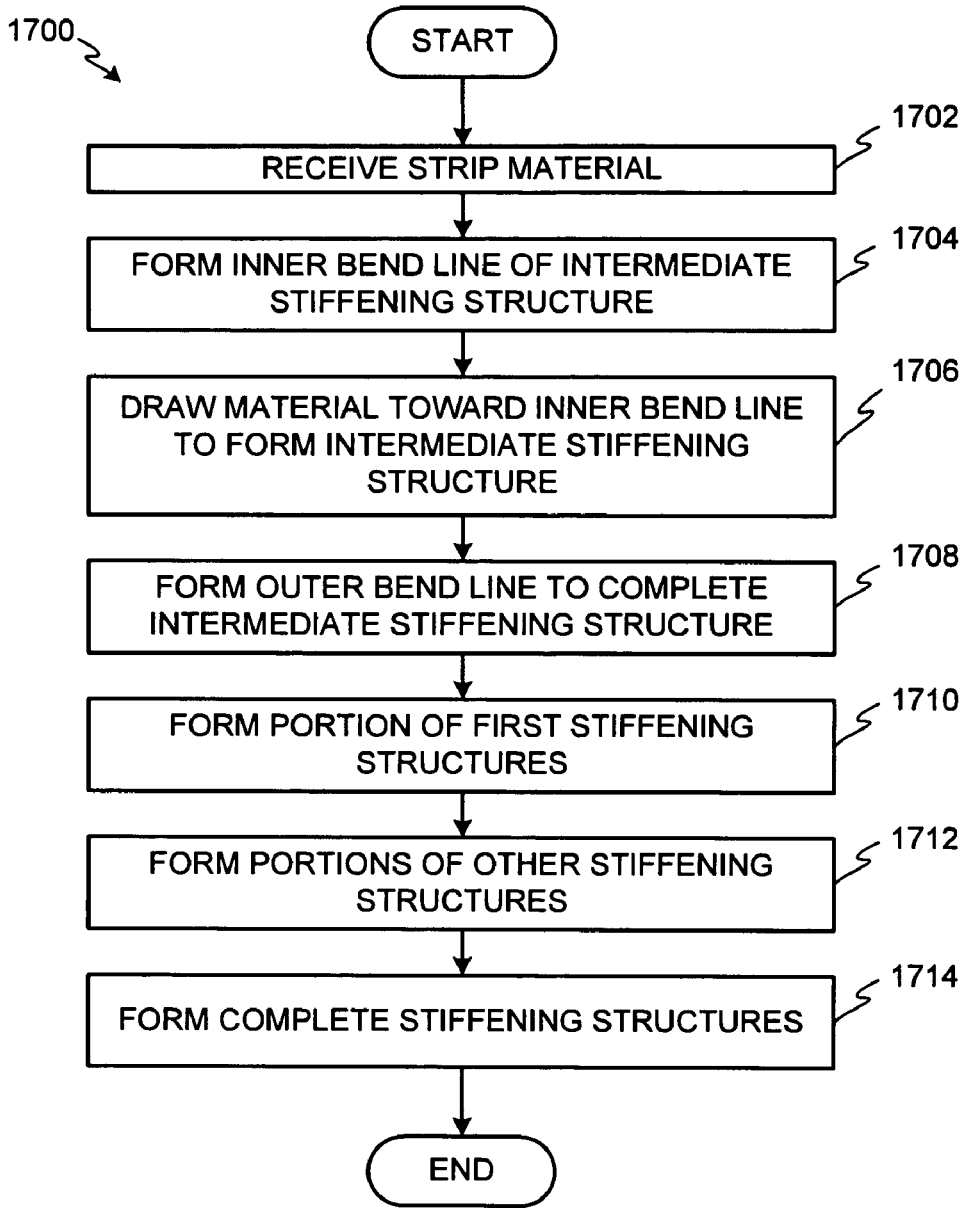
FIG. 17 is a flow diagram of an example method of forming stiffening structures in a strip material.
Figure 18:
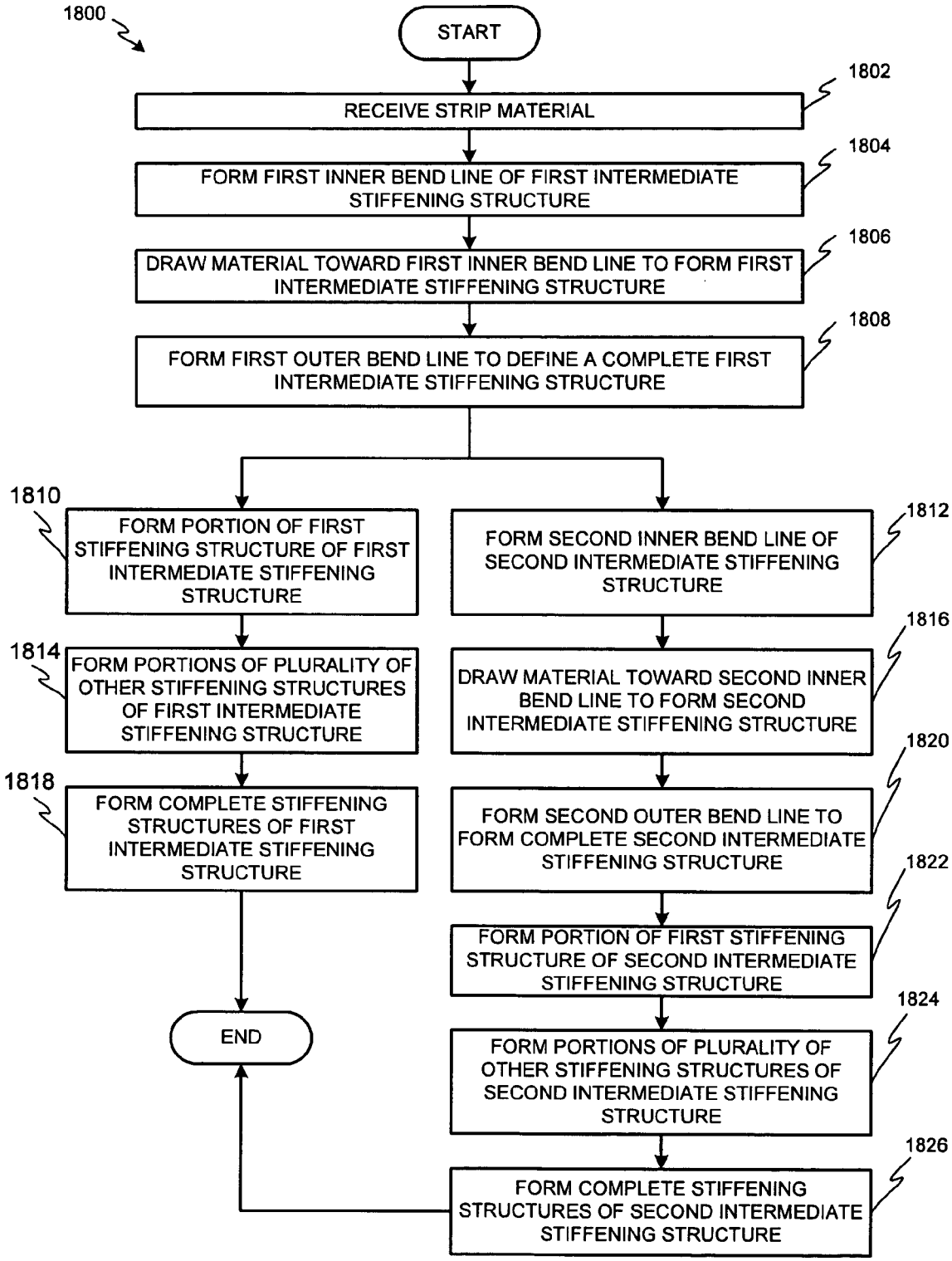
FIG. 18 is a flow diagram of another example method of forming stiffening structures in a strip material.

FIGS. 17 through 18 are example methods that may be used to form reinforced strip material (e.g., the example reinforced strip material 200 of FIG. 2) by forming stiffening structures (e.g., the stiffening structures 202 of FIG. 1) in a strip material (e.g., the strip material 102 of FIG. 1). The example methods may be implemented using, for example, the roll-former system 100 of FIG. 1. Although, the example methods are described below as a particular sequence of operations, one or more operations may be rearranged, added, and/or removed to achieve the same or similar results as those described herein.

FIG. 17 is a flow diagram of an example method of forming stiffening structures (e.g., the stiffening structures 202 of FIG. 2) in a strip material (e.g., the strip material 102 of FIG. 1). As described above in connection with FIG. 7, the stiffening structures 202 are formed by first forming an intermediate stiffening structure (e.g., the intermediate stiffening structures 706*a-b*) and then using the material from which the intermediate stiffening structure is formed to form one or more of the stiffening structures 202. For purposes of clarity, the example method of FIG. 17 is described with respect to forming the stiffening structures 202 of the second reinforced zone 204*b* (FIG. 2). However, the example method may be used to form any other stiffening structures in any other zones or regions of a material.

Initially, the strip material 102 is received (block 1702) by, for example, the roll-former system 100. Specifically, the strip material 102 may be received by the rolls 110*a* and 112*a* (FIGS. 1 and 8) of the first forming pass 108*a* (FIG. 1). The rolls 110*a* and 112*a* then form an inner bend line (e.g., the first inner bend line 708*a* of FIG. 7) (block 1704).

A portion (e.g., the end 710*a* of FIG. 7) of the strip material 102 is then drawn toward the inner bend line 708*a* to form the intermediate stiffening structure 706*a* (block 1706). For example, the material 102 may be drawn using a sequence of one or more roll assemblies such as, for example, the sequence of the roll assemblies in forming passes 108*a-e*. An outer bend line (e.g., the first outer bend line 714*a* of FIG. 7) is then formed adjacent to or juxtaposed to the inner bend line to complete the intermediate stiffening structure 706*a* (block 1708) such that the intermediate stiffening structure 706*a* is located between the inner bend line 708*a* and the outer bend line 714*a*. A subsequent roll assembly (e.g., the rolls 110*f* and 112*f*) then forms a portion of a first stiffening structure (block 1710). The portion of the first stiffening structure may be formed by forming bend lines on either side of the maximum location 712*a* (FIG. 7) of the intermediate stiffening structure 706*a*.

Figure 14:
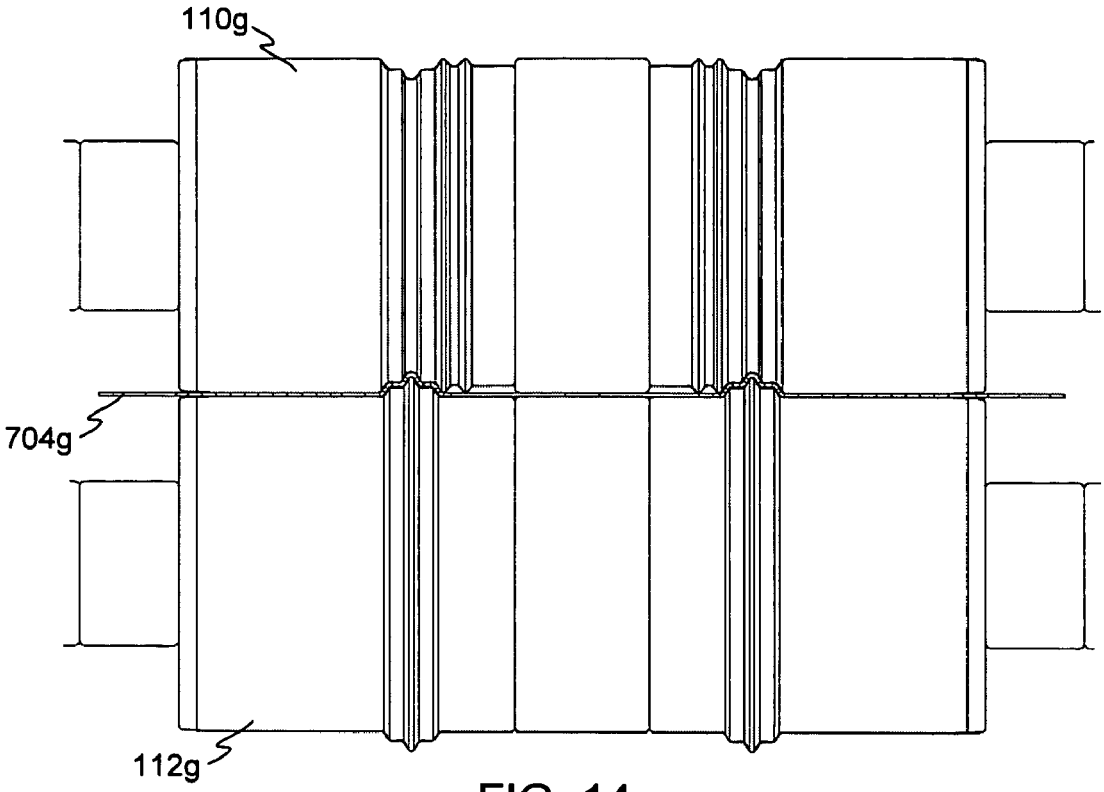
Figure 15:
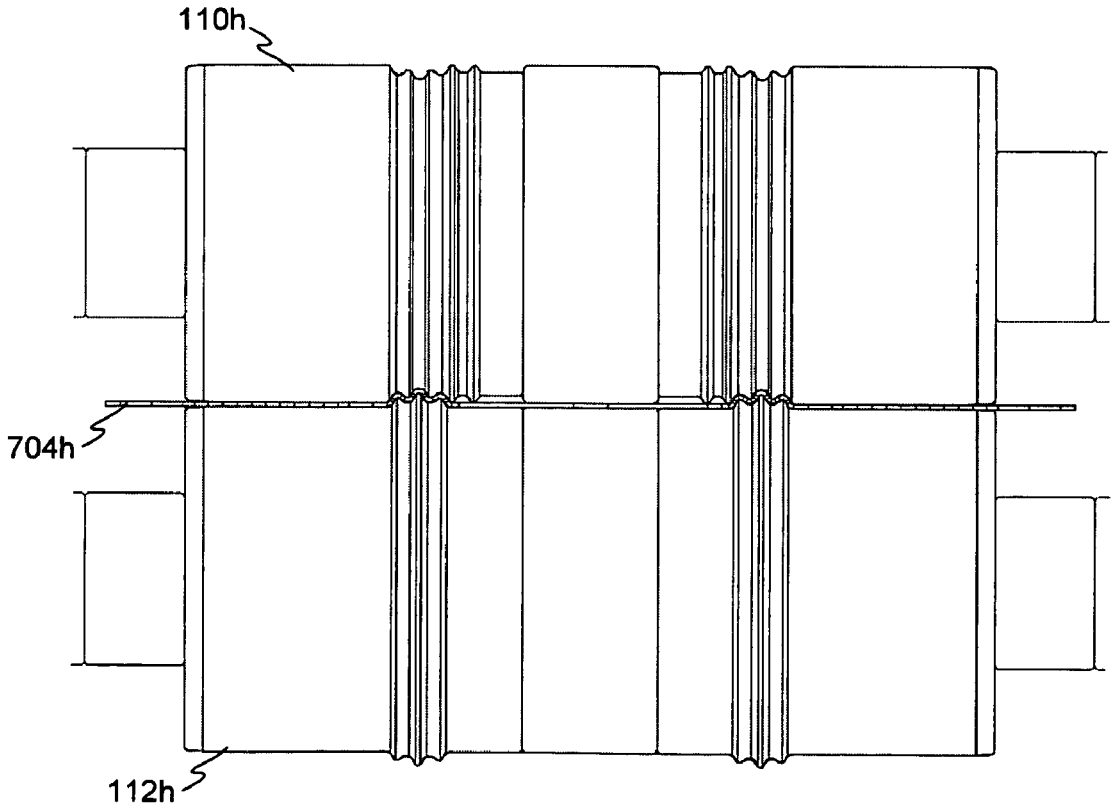
Figure 16:
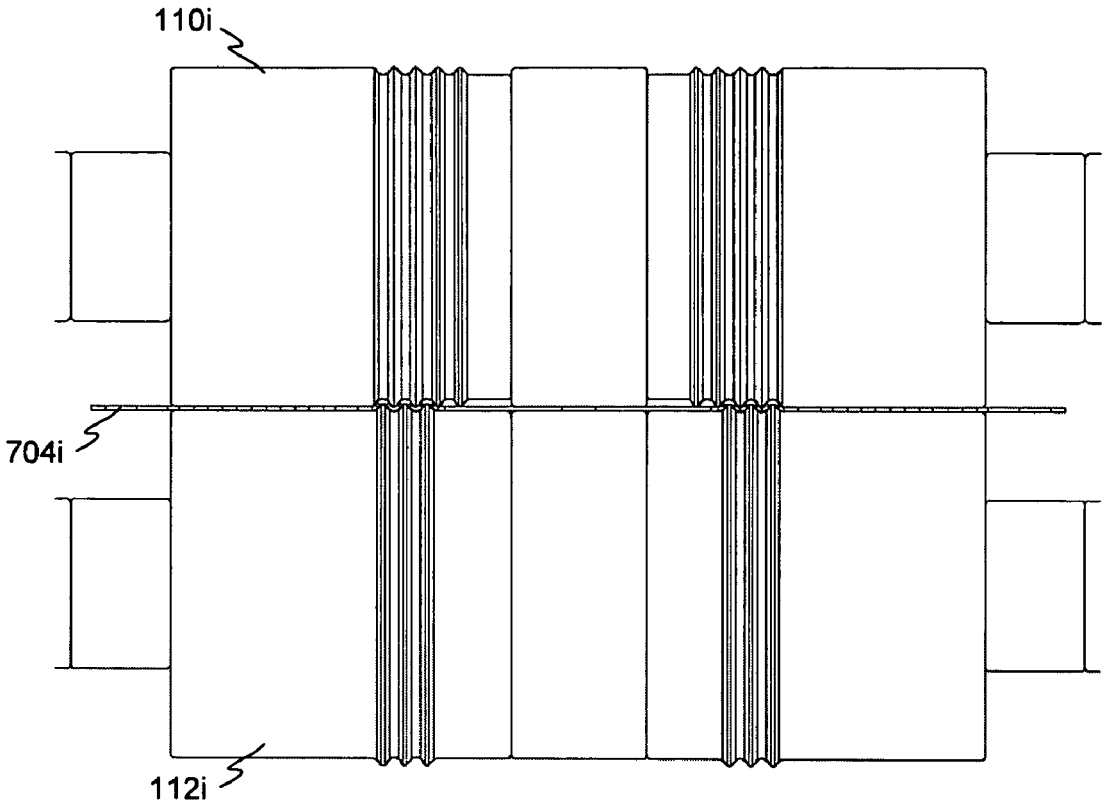

One or more subsequent roll assemblies (e.g., the rolls 110*g*, 112*g* and 110*h*, 112*h*) may then form portions of a plurality of other stiffening structures (block 1712). For example, the plurality of other stiffening structures may be second and third stiffening structures formed on opposing sides of the first stiffening structure as shown in FIGS. 14 and 15. The complete stiffening structures are then formed (block 1714) by one or more subsequent roll assemblies (e.g., the rolls 110*i* and 112*i*) to form a substantially planar reinforced zone (e.g., the second reinforced zone 204*b*).

FIG. 18 is a flow diagram of another example method of forming stiffening structures (e.g., the stiffening structures 202 of FIG. 2) in a strip material (e.g., the strip material 102 of FIG. 1). For purposes of clarity, the example method of FIG. 18 is described with respect to forming the stiffening structures 202 of the second reinforced zone 204*b* (FIG. 2) and the first reinforced zone 204*a* (FIG. 2). However, the example method may be used to form any other stiffening structures in any other zones or regions of a component.

The example method of FIG. 18 first forms a first intermediate stiffening structure (e.g., the intermediate stiffening structure 706*a* of FIG. 7) corresponding to the second reinforced zone 204*b* and then forms a second intermediate stiffening structure corresponding to the first reinforced zone 204*a*. In general, forming innermost intermediate stiffening structures first and outermost intermediate stiffening structures last enables the strip material 102 to be drawn from width ends (e.g., the ends 710*a* and 710*b*) of the strip material 102 without stretching the strip material 102.

Initially, the strip material 102 is received (block 1802) by, for example, the roll-former system 100. Specifically, the strip material 102 may be received by the rolls 110*a* and 112*a*

(FIGS. 1 and 8) of the first forming pass 108*a* (FIG. 1). The rolls 110*a* and 112*a* then form a first inner bend line (e.g., the first inner bend line 708*a* of FIG. 7) (block 1804).

A portion (e.g., the end 710*a* of FIG. 7) of the strip material 102 is then drawn toward the first inner bend line 708*a* to form a first intermediate stiffening structure (e.g., the intermediate stiffening structure 706*a*) (block 1806). For example, the material may be drawn using a sequence of one or more roll assemblies such as, for example, the sequence of the roll assemblies in forming passes 108*a-e*. A first outer bend line (e.g., the first outer bend line 714*a* of FIG. 7) is then formed juxtaposed to the first inner bend line 708*a* to complete the intermediate stiffening structure 706*a* (block 1808) such that the intermediate stiffening structure 706*a* is located between the first outer bend line 714*a* and the first inner bend line 708*a*.

The operations of block 1810 and block 1812 may then be performed substantially simultaneously via a roll assembly configured to begin forming a portion of a first stiffening structure (block 1810) and a second inner bend line (block 1812) juxtaposed to the first outer bend line 714*a* and associated with a second intermediate stiffening structure. For example, the ends of the rolls 110*f* and 112*f* may be modified to form a second inner bend line between the first outer bend line 714*a* and the end 710*a*. The second inner bend line may be used to form a second intermediate stiffening structure corresponding to the first reinforced zone 204*a*.

The operations of block 1814 and block 1816 may be performed substantially simultaneously via a roll assembly. For example, the roll assembly may be configured to begin forming portions of a plurality of other stiffening structures (e.g., second and third stiffening structures) (block 1814) in the first intermediate stiffening structure and to draw a portion (e.g., the end 710*a* of FIG. 7) of the strip material 102 toward the second inner bend line (block 1816). For example, the roll assemblies 110*g*, 112*g* and 110*h*, 112*h* may be modified to include forming portions on their roll ends to draw material toward the second inner bend line. In this manner, the second intermediate stiffening structure may be formed at substantially the same time as the stiffening structures associated with the first intermediate stiffening structure (e.g., the stiffening structures associated with the second reinforced zone 204*b*).

The operations of block 1818 and block 1820 may also be performed substantially simultaneously via a roll assembly configured to finish forming the stiffening structures associated with the first intermediate stiffening structure (i.e., the stiffening structures associated with the second stiffening zone 204*b*) (block 1818) and form a second outer bend line (block 1820). The second outer bend line is juxtaposed the second inner bend line to form a complete second intermediate stiffening structure (e.g., an intermediate stiffening structure associated with the first reinforced zone 204*a*) such that the second intermediate stiffening structure is located between the second outer bend line and the second inner bend line. The rolls 110*i* and 112*i* may be modified to include forming portions on their roll ends that form a second outer bend line to form the complete second intermediate stiffening structure.

The operations of blocks 1822, 1824, and 1826 may be performed by a plurality of subsequent roll assemblies configured to form stiffening structures in the second intermediate stiffening structure (e.g., the stiffening structures 202 of the second reinforced zone 204*b*). More specifically, after the second intermediate stiffening structure is formed, a roll assembly may form a portion of a first stiffening structure in the second intermediate stiffening structure by forming bend lines on either side of the maximum location (i.e., the crest) of the second intermediate stiffening structure (block 1822). One or more subsequent roll assemblies then form portions of a plurality of other stiffening structures in the second intermediate stiffening structure (block 1824) by forming a plurality of bend lines parallel and adjacent to the first stiffening structure. A roll assembly may then form the complete stiffening structures of the second intermediate stiffening structure (block 1826) (e.g., the stiffening structures 202 of the first reinforced zone 204*a* of FIG. 7). The example method of FIG. 18 is then ended.

Although the operations of blocks 1812, 1816, 1820, 1822, 1824, and 1826 are described as forming the second reinforced zone 204*b* from a single intermediate stiffening structure (e.g., the second intermediate stiffening structure), the operations of those blocks may be modified to form only a portion of the stiffening structures 202 of the second reinforced zone 204*b*. Specifically, the stiffening structures 202 of the second reinforced zone 204*b* may be formed from two intermediate stiffening structures (e.g., the second intermediate stiffening structure and a third intermediate stiffening structure) by forming an innermost intermediate stiffening structure first, forming three of the stiffening structures 202 from the innermost intermediate stiffening structure, then forming an outermost stiffening structure, and forming three of the stiffening structures 202 from the outermost stiffening structure. In this manner, all of the stiffening structures 202 of the second reinforced zone 204*b* are formed from two adjacent intermediate stiffening structures.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method of forming stiffening structures in a material, comprising:

performing, via roll assemblies, at least operations (a), (b), and (c), the operations including:

(a) forming a first bend line in a material;

(b) following operation (a), drawing a portion of the material toward the first bend line to form an intermediate stiffening structure; and (c) following operation (b), forming a second bend line adjacent to the first bend line so that the intermediate stiffening structure is located between the first and second bend lines, the intermediate stiffening structure forming a continuous curved raised portion between the first and second bend lines; and performing, via the roll assemblies, the operation of forming a plurality of stiffening structures in the intermediate stiffening structure.

2. A method as defined in claim 1, wherein drawing the portion of the material toward the first bend line to form the intermediate stiffening structure comprises drawing the portion of the material without substantially stretching the portion of the material.

3. A method as defined in claim 1, wherein drawing the portion of the material toward the first bend line to form the intermediate stiffening structure comprises drawing the portion of the material while an end of the material portion is allowed to move substantially freely.

4. A method as defined in claim 1, wherein the plurality of stiffening structures are adjacent and substantially parallel rib structures, bead structures, ridges, or crimps.

5. A method as defined in claim 1, wherein forming the plurality of stiffening structures comprises forming a third bend line and a fourth bend line on either side of a maximum location of the intermediate stiffening structure.

6. A method as defined in claim 1, wherein forming the plurality of stiffening structures comprises bending the material to control a thickness of a stretch region relative to a thickness of a compression region.

7. A method as defined in claim 1, wherein forming the intermediate stiffening structure increases an amount of the material located between the first and second bend lines.

8. A method as defined in claim 1, wherein forming the plurality of stiffening structures comprises forming a reinforced zone in the material.

9. A method as defined in claim 1, wherein the material is a metallic strip material.

10. A method as defined in claim 1, wherein the portion of the material includes an end of the material.

11. A method as defined in claim 1, wherein the plurality of stiffening structures are formed while preserving the integrity of the material or a finish applied thereto.

12. A method as defined in claim 11, wherein preserving the integrity of the strip material includes preserving at least one of a material characteristic, a component characteristic, or a structural characteristic.

13. A method as defined in claim 11, wherein the finish is a galvanized finish.

14. A method of forming stiffening structures in a material, comprising:

performing, via roll assemblies, at least operations (a), (b), and (c), the operations including:

(a) forming a first inner bend line in a material;

(b) following operation (a), gathering a portion of the material toward the first inner bend line to form a first curved raised portion of the material; and (c) following operation (b), forming a first outer bend line adjacent to the first inner bend line so that the first curved raised portion is located between the first inner bend line and the first outer bend line; and performing, via the roll assemblies, the operations of:

substantially simultaneously forming a portion of a first stiffening structure in the first curved raised portion and forming a second inner bend line substantially parallel to the first outer bend line;

substantially simultaneously forming portions of a first plurality of stiffening structures in the first curved raised portion and drawing another portion of the material toward the second inner bend line to form a second curved raised portion of the material;

substantially simultaneously completing the first stiffening structure and the first plurality of stiffening structures in the first curved raised portion and forming a second outer bend line parallel to the second inner bend line so that the second curved raised portion is located between the second inner bend line and the second outer bend line; and forming a second plurality of stiffening structures in the second curved raised portion.

15. A method as defined in claim 14, wherein the first and second curved raised portions are intermediate stiffening structures.

16. A method as defined in claim 14, wherein forming the second plurality of stiffening structures comprises forming substantially parallel and adjacent bend lines in the second curved raised portion.

17. A method as defined in claim 14, wherein forming the first stiffening structure comprises forming a third bend line and a fourth bend line on either side of a maximum location of the first curved raised portion.

18. A method as defined in claim 14, wherein forming the first and second plurality of stiffening structures comprises bending the material to control a thickness of a stretch region relative to a thickness of a compression region.

19. A method as defined in claim 14, wherein forming the first curved raised portion increases an amount of the material between the first inner bend line and the first outer bend line.

20. A method as defined in claim 14, wherein forming the first stiffening structure and the first and second plurality of stiffening structures comprises forming reinforced zones in the material.

21. A method as defined in claim 14, wherein the material is a metallic strip material.

22. A method as defined in claim 14, wherein the first and second plurality of stiffening structures are formed while preserving the integrity of the material or a finish applied thereto.

23. A system configured to form stiffening structures in a material, comprising:

roll assemblies of a roll-former system, the roll assemblies configured to perform at least the operations of (a), (b), and (c) by applying forces on a material, the operations including:

(a) forming a first bend line in the material;

(b) following operation (a), drawing a portion of the material toward the first bend line to form an intermediate stiffening structure; and (c) following operation (b), forming a second bend line adjacent to the first bend line so that the intermediate stiffening structure forms a continuous curved raised portion between the first and second bend lines; and the roll assemblies further to perform the operation of forming a plurality of stiffening structures in the intermediate stiffening structure.

24. A system as defined in claim 23, wherein the roll assemblies are configured to increase an amount of the material between the first and second bend lines by drawing the material toward the first bend line.

25. A system as defined in claim 23, wherein at least one of an upper roll or a lower roll of some of the roll assemblies comprises tapered roll ends configured to allow the material to move substantially freely between opposing roll ends of the upper roll and the lower roll.

26. A system as defined in claim 23, wherein at least some of the roll assemblies are configured to substantially simultaneously form the plurality of stiffening structures and another intermediate stiffening structure.

27. A system as defined in claim 23, wherein the roll assemblies are configured to bend the material to control a thickness of a stretch region relative to a thickness of a compression region.

28. A system as defined in claim 23, wherein the plurality of stiffening structures are formed while preserving the integrity of the material or a finish applied thereto.

29. A system as defined in claim 23, wherein the plurality of stiffening structures comprise a corrugated section extending along at least a part of a length of the material.

30. A system configured to form stiffening structures in a material, comprising:

roll assemblies of a roll-former system, the roll assemblies configured to perform at least the operations of (a), (b), and (c) by applying forces on a material, the operations including:

(a) forming a first inner bend line in the material;

(b) following operation (a), gathering a portion of the material toward the first inner bend line to form a first curved raised portion of the material; and (c) following operation (b), forming a first outer bend line adjacent to the first inner bend line so that the first curved raised portion is located between the first inner bend line and the first outer bend line; and the roll assemblies further configured to perform the operations of:

substantially simultaneously forming a portion of a first stiffening structure in the first curved raised portion and forming a second inner bend line substantially parallel to the first outer bend line;

substantially simultaneously forming portions of a first plurality of stiffening structures in the first curved raised portion and drawing another portion of the material toward the second inner bend line to form a second curved raised portion of the material;

substantially simultaneously completing the first stiffening structure and the first plurality of stiffening structures in the first curved raised portion and forming a second outer bend line parallel to the second inner bend line so that the second curved raised portion is located between the second inner bend line and the second outer bend line; and forming a second plurality of stiffening structures in the second curved raised portion.

31. A system as defined in claim 30, wherein the roll assemblies are configured to bend the material to control a thickness of a stretch region relative to a thickness of a compression region.

32. A system as defined in claim 30, wherein forming the first curved raised portion increases an amount of the material between the first inner bend line and the first outer bend line.

33. A system as defined in claim 30, wherein at least one of an upper roll or a lower roll of some of the roll assemblies comprises tapered roll ends configured to allow the material to move substantially freely between opposing roll ends of the upper roll and the lower roll.

34. A system as defined in claim 30, wherein the first and second plurality of stiffening structures are formed while preserving the integrity of the material or a finish applied thereto.

35. A system as defined in claim 30, wherein the first and second curved raised portions are intermediate stiffening structures.

* * * * *